US006745424B1

(12) United States Patent
Pimentel et al.

(10) Patent No.: US 6,745,424 B1
(45) Date of Patent: Jun. 8, 2004

(54) PORTABLE GOLF BALL AND CLUB CLEANING DEVICE

(75) Inventors: Franklin A. Pimentel, Somers Point, NJ (US); Peter Zielinski, Millville, NJ (US); Richard A. Lappine, Millville, NJ (US)

(73) Assignee: CluBall Cleaner LLC, Somers Point, NJ (US)

( * ) Notice: Subject to any disclaimer, the term of this patent is extended or adjusted under 35 U.S.C. 154(b) by 92 days.

(21) Appl. No.: 10/253,277

(22) Filed: Sep. 25, 2002

(51) Int. Cl.[7] ..... A63B 47/04
(52) U.S. Cl. ..... 15/21.2; 15/104.92
(58) Field of Search ..... 15/21.2, 104.92, 15/160

(56) References Cited

U.S. PATENT DOCUMENTS

| | | | | | |
|---|---|---|---|---|---|
| 1,918,529 | A | * | 7/1933 | Frater | 15/21.2 |
| 3,101,497 | A | * | 8/1963 | Derkocz | 15/21.2 |
| 3,221,355 | A | | 12/1965 | Grommes | 15/160 |
| 3,380,095 | A | * | 4/1968 | Piper | 15/97.1 |
| 3,400,416 | A | * | 9/1968 | Nicholson et al. | 15/21.2 |
| 4,734,952 | A | | 4/1988 | Parchment et al. | 15/104.92 |
| 4,945,596 | A | | 8/1990 | Chang et al. | 15/21.2 |
| 4,965,906 | A | | 10/1990 | Mauro | 15/104.92 |
| 5,081,735 | A | | 1/1992 | Wyatt et al. | 15/104.92 |
| 5,155,883 | A | | 10/1992 | Legault | 15/21.2 |
| 5,404,610 | A | | 4/1995 | Coyer et al. | 15/104.92 |
| D366,565 | S | | 1/1996 | Harper | D4/121 |
| D372,755 | S | | 8/1996 | Nardi | D21/234 |
| 5,572,761 | A | | 11/1996 | Meyer | 15/21.2 |
| D386,847 | S | | 11/1997 | Petrie | D32/35 |
| 5,915,432 | A | | 6/1999 | Trummer | 15/23 |
| 5,940,918 | A | | 8/1999 | Binette | 15/21.1 |
| 6,115,866 | A | | 9/2000 | Trummer | 15/23 |

* cited by examiner

*Primary Examiner*—Mark Spisich
(74) *Attorney, Agent, or Firm*—Norman E. Lehrer

(57) ABSTRACT

A portable golf ball and club cleaning device that includes an elongated housing having sidewalls forming a chamber therein and a lid hingedly connected to the housing is disclosed. The chamber holds a cleaning medium and a plurality of brushes extend inwardly into the chamber from the sidewalls. An opening is formed between the brushes through which a golf club is adapted to fit. An elongated panel member with a hole and cut-out portions is releasably attached to the interior surface of the lid and acts as a ball holder. In order to clean a ball, the panel member is removed from the lid. A ball is inserted through the hole and cut-out portions and is placed into the opening of the housing so that the ball contacts the cleaning medium. The device also includes a clip for securing the housing to a golf bag or other golf equipment.

7 Claims, 3 Drawing Sheets

PORTABLE GOLF BALL AND CLUB CLEANING DEVICE

BACKGROUND OF THE INVENTION

The present invention is directed toward a golf ball and club cleaner and more particularly, toward a cleaning device that is compact and portable.

Golf balls and golf clubs, during the course of play, often become dirty with mud, dirt, grass, and the like and thereby, interfere with a golfer's game. For example, the dirt may accumulate on a ball and affect how the ball rolls, especially when putting. Also, the ball may become difficult to find in a sand trap or in the rough. Similarly, dirt that accumulates on the head of a golf club can affect how far and/or how accurately the ball will travel.

Golfers may clean their equipment by wiping the club or ball with a rag or their hands, by scraping the ball or club along the vegetation found along the course, or by using any body of water found along the course. Obviously, these are rather crude and ineffective methods for keeping one's equipment clean and in good working condition.

The problem of dirty golf balls and clubs has been addressed and solutions provided by golf course owners. For example, many golf courses provide facilities where golf balls may be cleaned. These facilities generally include containers housing a cleaning solution and/or brushes by which the balls may be cleaned.

However, these cleaning areas may not be conveniently located or may not coincide with a golfer's need. Furthermore, such areas may not be maintained well. That is, the cleaning solution may not be changed as often as needed, thereby defeating the purpose of the cleaner. Also, the cleaning solution may be completely absent from the container.

Various prior patents have also addressed the problems inherent with playing with dirty golf clubs and balls and suggest various devices and methods for cleaning golf balls and clubs during the course of play or otherwise. For example, U.S. Pat. No. 4,734,952 to Parchment et al. discloses a cleaning apparatus for golf clubs that includes a tub for holding a cleaning solution and brushes within the tub for removing dirt from the head of a golf club when the club is inserted into the tub. The tub may be carried around with the golfer or mounted on a golf cart.

U.S. Pat. No. 4,945,596 to Chang et al. discloses a golf ball and golf club scrubber that includes a container with a lid and bristles or brushes that line the interior of the chamber. The chamber may house a cleaning solution. In order to use the device, a golf ball holder is inserted into the container where the bristles contact and clean the ball. The container may be attached to a golf bag.

U.S. Pat. No. 4,965,906 to Mauro discloses a golf ball and club head cleaner that includes a housing with a section to clean golf club heads that includes brushes and a cleaning solution contained therein. The head of the golf club is inserted into the housing so that the brushes clean the head. The housing also has a section in which a holder for a golf ball is inserted so that the brushes and a cleaning solution may clean the ball.

All of the patents discussed above, however, are rather large and bulky and are not easily transported along the course while the golfer is playing a game. U.S. Pat. No. 5,572,761 to Meyer discloses a portable golf ball and club head cleaner that includes a housing within which a cleaning solution and brushes may be contained and a retainer for holding a ball within the housing in order to clean the same. The housing may be attached to a golf bag. This patent, however, appears to have an awkward shape thereby causing transport of the device to be inconvenient.

Thus, a need exists for a compact, portable golf ball and club cleaning device which is easy and convenient to transport and use.

SUMMARY OF THE INVENTION

The present invention is designed to overcome the deficiencies of the prior art discussed above. It is an object of the present invention to provide a golf ball and club cleaner that is compact and portable.

It is another object of the present invention to provide a golf ball and club cleaning device that is easy and convenient to use.

It is a further object of the present invention to provide a golf ball and club cleaner that may be releasably attached to other golf equipment.

In accordance with the illustrative embodiments demonstrating features and advantages of the present invention, there is provided a portable golf ball and club cleaning device that includes an elongated housing having sidewalls forming a chamber therein and a lid hingedly connected to the housing. The chamber is adapted to hold a cleaning medium. A plurality of brushes extend inwardly into the chamber from the sidewalls. An opening is formed between the brushes through which a golf club is adapted to fit. Means for holding a golf ball is releasably attached to the interior surface of the lid. The ball holding means includes an elongated panel member with a hole and cut-out portions located adjacent thereto. The cut-out portions form a living hinge. The ball is inserted into the hole and cut-out portions and is held therein. In order to clean a ball, the panel member is removed from the lid. A ball is inserted through the hole and cut-out portions and is placed into the opening of the housing so that the ball contacts the cleaning medium. The means for attaching the elongated panel member to the interior surface of the lid includes a protrusion extending outwardly from the lid and an aperture formed on the panel member wherein the protrusion fits within the aperture. The device also includes means for securing the housing to a golf bag or other golf equipment.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 3:
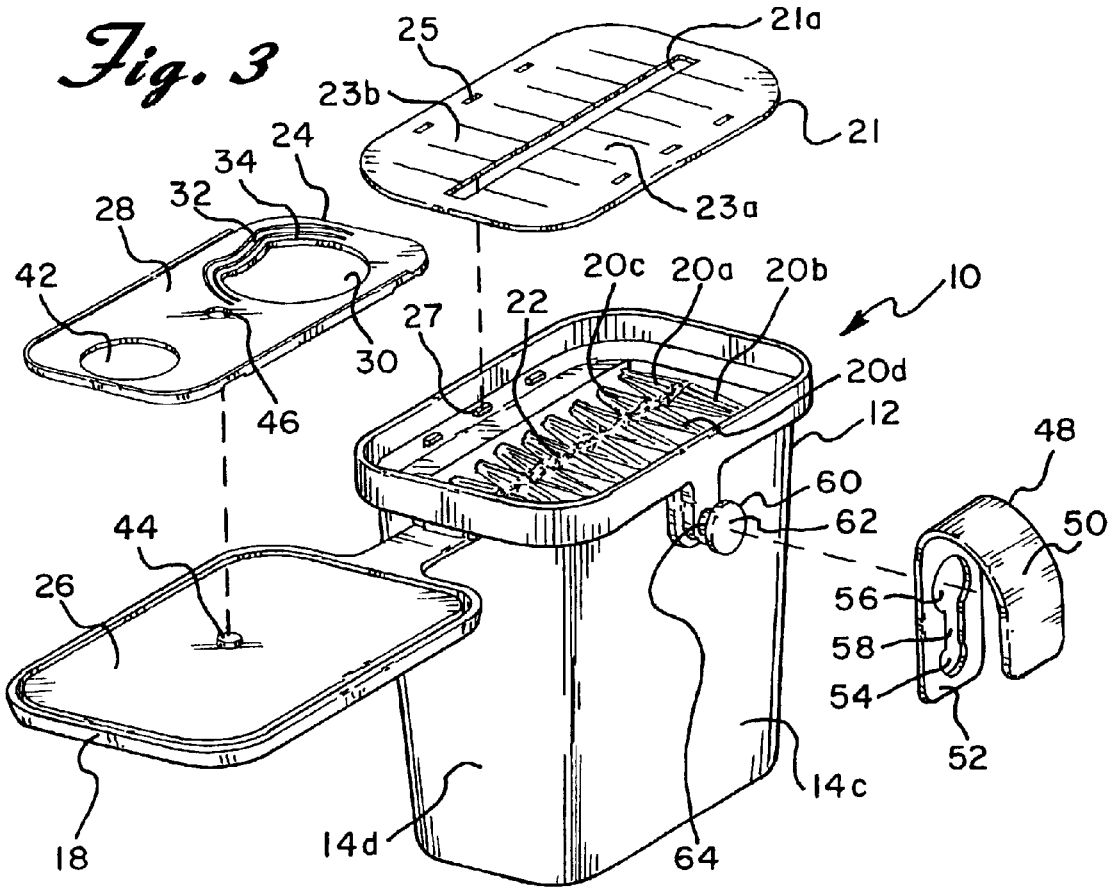
FIG. 3 is a rear perspective view of the cleaning device of the present invention with the lid open and the clip removed.

Referring now to the drawings in detail wherein like reference numerals have been used throughout the various figures to designate like elements, there is shown in FIG. 3 a golf ball and club cleaning device constructed in accordance with the principles of the present invention and designated generally as 10.

The golf ball and club cleaning device of the present invention essentially includes an elongated, generally rectangular housing 12 having sidewalls 14*a*–14*d* forming a chamber 16 therein and a lid 18 hingedly connected to the housing 12. The chamber 16 is adapted to hold a cleaning medium such as a liquid detergent or the like. A plurality of brushes, seen for example as 20*a*–20*d*, or similar types of cleaning implements known in the art extend from the interior front and rear sidewalls 14*a* and 14*c* of the housing 12 into the chamber 16. A narrow opening or space 22 is formed between the brushes. The purpose of this space will be discussed in greater detail below. Secured above the plurality of brushes is a splash guard 21 that prevents the cleaning medium from leaking out of the chamber 16. The splash guard 21 is generally rectangular with an elongated opening 21*a* and a plurality of flexible members, shown for example, as 23*a* and 23*b*. A plurality of apertures may be located along the sides of the splash guard 21 shown, for example, as 25. Corresponding protuberances or projections, shown for example as 27, are located along the top of the housing 12. Each protuberance snap fits into its corresponding aperture so that the splash guard 21 is held in place on the housing 12.

Figure 4:
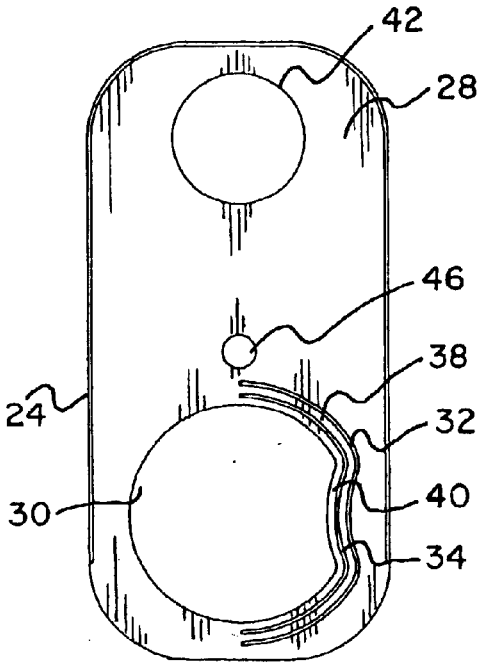
FIG. 4 is a top plan view of the golf ball holder of the present invention.
Figure 5:
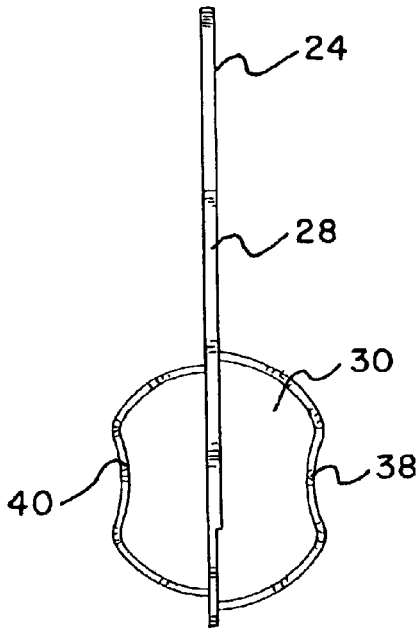
FIG. 5 is a side view of the golf ball holder of the present invention.
Figure 7:
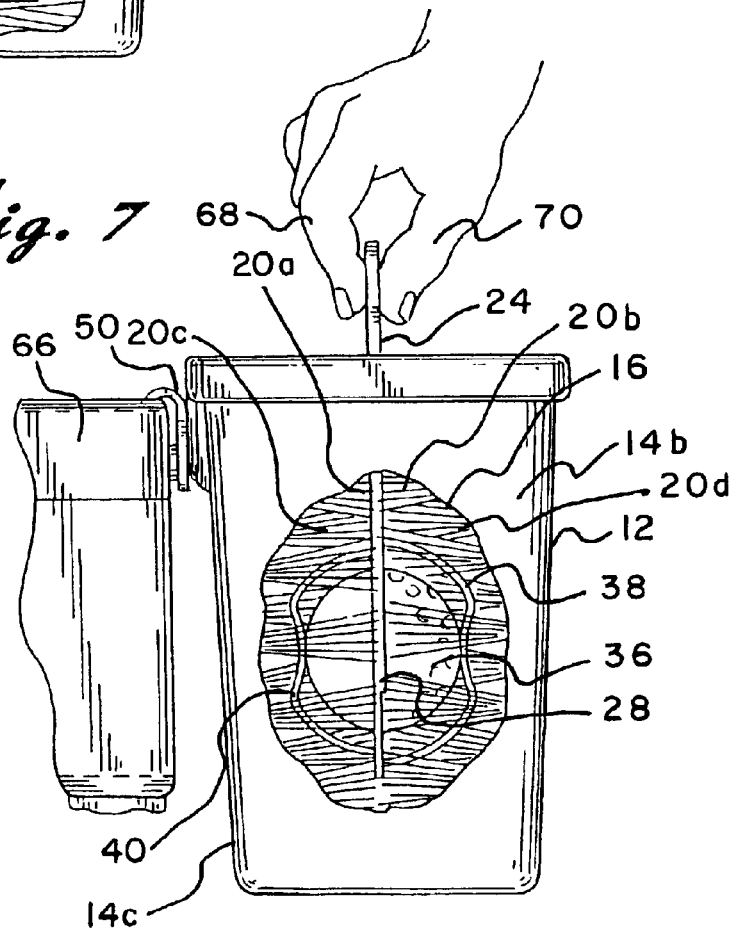
FIG. 7 illustrates a golf ball being cleaned by the present invention.

Means 24 for holding a golf ball is releasably attached to the interior surface 26 of the lid 18. The ball holding means 24 includes an elongated panel member 28 with a generally circular hole 30 and cut-out portions 32 and 34 located adjacent one side of the hole 30. (See FIG. 4.) A standard golf ball 36 is capable of fitting into the hole 30 and cut-out portions 32 and 34 and is held therein by way of an interference fit. That is, the cut-out portions 32 and 34 form two strips 38 and 40 which are flexed and act as a living hinge so that the ball 36 fits securely between and is held in place by the strips 38 and 40. (See FIGS. 5 and 7.) An aperture 42 spaced apart from the hole 30 and cut-out portions 32 and 34 is also formed on the panel member 28. The purpose of the aperture 42 will be discussed below. The panel member 28 is made from a flexible plastic material or the like.

In a preferred embodiment the means for releasably attaching the elongated panel member 28 to the interior surface 26 of the lid 18 includes a protrusion 44 extending outwardly from the lid 18 and an aperture 46 formed on the panel member 28 wherein the protrusion 44 snap fits into the aperture 46. (FIG. 3.) Other types of releasable attaching means known in the art may also be used.

The device also includes means for securing the housing 12 to a golf bag or other golf equipment. The securing means includes a clip 48 with a curved portion 50 and an elongated member 52 through which two generally circular openings 54 and 56 are formed. Opening 56 is larger in diameter than opening 54. The openings 54 and 56 are joined together by an elongated slot 58. Located on the exterior surface of the rear sidewall 14*c* of the housing 12 is a pin 60 extending outwardly. The pin 60 includes a head 62 and neck portion 64 extending from the head 62. The neck portion 64 is attached to the housing 12. (See FIG. 3.) The head 62 and neck portion 64 are adapted to fit within the larger opening 56. The head 62, however, cannot fit within the slot 58. The neck portion 64 is capable of fitting within the slot 58, sliding therethrough, and securely filling into the smaller opening 54. The diameter of the smaller opening 54 is also smaller than the diameter of the head 62 of the pin 60. Thus, the clip 48 is secured to the pin 60.

Figure 1:
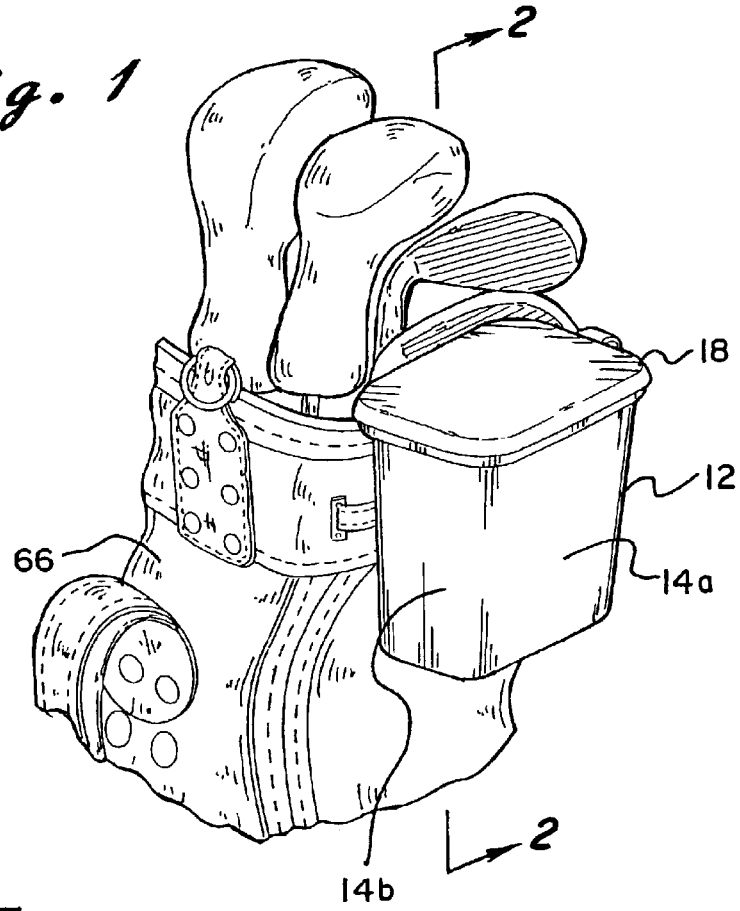
FIG. 1 illustrates the cleaning device of the present secured to a golf bag.
Figure 2:
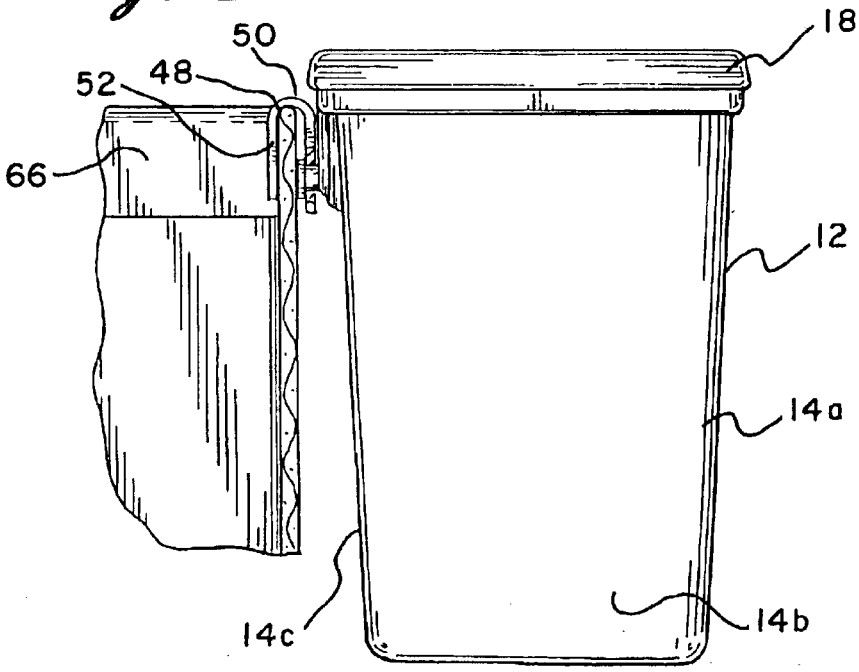
FIG. 2 is a cross-sectional view taken through line 2—2 of FIG. 1.

Once the clip 48 is secured to the housing 12, the curved portion 50 of the clip 48 can be hooked onto a golf bag 66 or other golf equipment. (See FIGS. 1 and 2.) In order to remove the housing 12 from the bag 66, the housing is grasped by a person and moved upwardly so as to unhook the clip 48 from the bag 66. The clip 48 is then moved downwardly so that the neck portion 64 of the pin 60 is free to slide back through the slot 58 and into the larger opening 56, thereby allowing the head 62 to slip out of the opening 56. The cleaning device may be used while it is attached to other equipment or may be free-standing. Because of the flexible, pivoting nature of the pin 60 within the clip 48, the housing 12 will remain in an upright or generally vertical position even if the golf bag 66 is jostled or dropped.

In order to clean a golf ball, the lid 18 of the housing 12 is opened and the panel member 28 is removed from the lid 18 of the housing 12. A ball 36 is then inserted through the hole 30 of the panel member 28 and cut-out portions 32 and 34 are flexed to surround the ball as discussed above. A person inserts his/her finger 68 and thumb 70 through the aperture 42 of the panel member 28 in order to grasp the panel member 28 and place it into the space 22 between the brushes where the ball 36 contacts the cleaning medium. The panel member 28 is moved through the opening 21 a and flexible members 23*a* and 23*b*, for example, of the splash guard 21. The panel member 28 may be moved up and down within the chamber 16 so that the ball 36 is scrubbed by the brushes and is cleaned. (See FIG. 7.) Once the ball 36 is clean, it may be removed from the hole 30 of the panel member 28 and the panel member 28 secured into the interior surface 26 of the lid 18 of the housing 12 once again.

Figure 6:
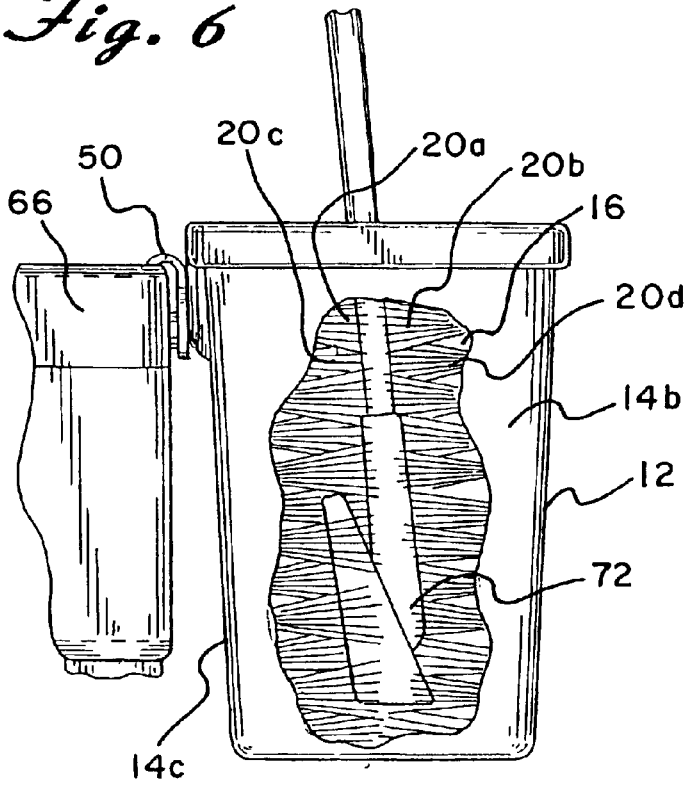
FIG. 6 illustrates a golf club being cleaned by the present invention.

In order to clean the head of a golf club, the head 72 is inserted through the opening 21 a of the splash guard 21, past the flexible members 23*a* and 23*b*, for example, and into the space 22 between the brushes within the chamber 16 of the housing 12 so that it contacts the brushes and cleaning medium. (See FIG. 6.) The club head 72 may be moved up and down, thereby using the brushes to scrub the head 72. Once the club head 72 is cleaned it may be removed and the lid 18 closed so that the lid 18 is locked into place, preventing the cleaning medium from leaking out of the housing.

The present invention may be embodied in other specific forms without departing from the spirit or essential attributes thereof and accordingly, reference should be made to the appended claims rather than to the foregoing specification as indicating the scope of the invention.

We claim:

1. A portable golf ball and club cleaning device comprising:

an elongated housing having sidewalls forming a chamber therein and a lid hingedly connected to said housing, said chamber being adapted to hold a cleaning medium and containing a plurality of brushes extending into said chamber from said sidewalls;

an opening formed between said brushes through which a golf club may be inserted;

means for holding a golf ball; and means for releasably attaching said holding means to the interior surface of said lid of said housing.

2. The portable golf ball and club cleaning device of claim 1 wherein said ball holding means includes an elongated panel member, said panel member including a generally circular hole and cut-out portions located adjacent thereto through which the ball is held when said panel member is inserted through said opening of said housing.

3. The portable golf ball and club cleaning device of claim 2 wherein said panel member is made from a flexible plastic material.

4. The portable golf ball and club cleaning device of claim 2 wherein said attaching means includes a protrusion extending outwardly from said lid and an aperture formed on said panel member wherein said protrusion snap fits within said aperture.

5. The portable golf ball and dub cleaning device of claim 1 further including means for securing said housing to a golf bag.

6. The portable golf ball and club cleaning device of claim 5 wherein said securing means includes a clip with a curved portion adapted to hook onto a golf bag and an elongated member through which two generally circular openings are formed, the diameter of one of said openings being larger than the diameter of the other of said openings, said openings being joined by an elongated slit.

7. The portable golf ball and club cleaning device of claim 6 wherein said securing means further includes a pin formed on an exterior surface of said housing, said pin having a head and a neck portion extending therefrom, said head and neck portion being adapted to fit within said larger opening, said neck portion of said pin being adapted to slide through said elongated slit and fitting into said smaller opening, said smaller opening having a diameter smaller than the diameter of said head.

* * * * *